United States Patent [19]

Gabalda

[11] Patent Number: 4,905,467

[45] Date of Patent: Mar. 6, 1990

[54] MACHINE FOR CONTINUOUS TWISTING AND CABLING

[75] Inventor: Carlos M. Gabalda, Granges Les Valence, France

[73] Assignee: ICBT Lyon, Caluire, France

[21] Appl. No.: 286,262

[22] Filed: Dec. 19, 1988

[30] Foreign Application Priority Data

Dec. 22, 1987 [FR] France ..... 87 18248

[51] Int. Cl.[4] ..... D01H 7/90; D01H 1/10; D01H 7/00

[52] U.S. Cl. ..... 57/58.54; 57/63; 57/64; 57/66; 57/75; 57/90

[58] Field of Search ..... 57/58.52, 58.54, 58.55, 57/59, 60, 63, 64, 66, 75, 90

[56] References Cited

U.S. PATENT DOCUMENTS

| | | | |
|---|---|---|---|
| 897,129 | 8/1908 | Nightingale . | |
| 2,550,136 | 4/1951 | Clarkson | 57/58.54 |
| 2,887,841 | 5/1959 | Ridgway | 57/60 |
| 2,897,647 | 8/1959 | Woods et al. | 57/60 |
| 2,979,882 | 4/1961 | Bromley et al. | 57/58.54 X |
| 3,834,146 | 9/1974 | Nessler et al. | 57/58.54 |
| 3,846,965 | 11/1974 | Matsumura et al. | 57/58.52 |

FOREIGN PATENT DOCUMENTS

| | | |
|---|---|---|
| 1053985 | 3/1959 | Fed. Rep. of Germany . |
| 1062599 | 4/1954 | France . |
| 788242 | 12/1957 | United Kingdom . |

*Primary Examiner*—John Petrakes

*Attorney, Agent, or Firm*—Arnold, White & Durkee

[57] ABSTRACT

Machine for continuous twisting and cabling of filaments of the type including a predetermined number of work positions disposed on a common support frame (4), each work position including, taken in order according to the process of transformation of the filaments:

a feeding and twisting section (1) for each of the elementary filaments, on each side of the machine;

means (2) for the return and joining of a predetermined number of elementary filaments thus twisted and;

a cabling and winding section (3);

characterized in that the cabling and winding section (3) is common to the two feeding and twisting sections (1) and is constituted by spindles disposed side by side in the vertical plane of symmetry (AA) passing between the two feeding and twisting sections (1).

4 Claims, 3 Drawing Sheets

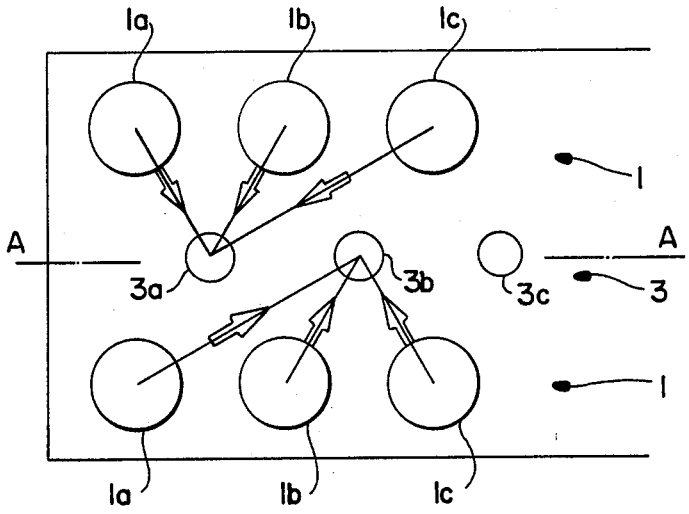
Fig. 3
Fig. 4
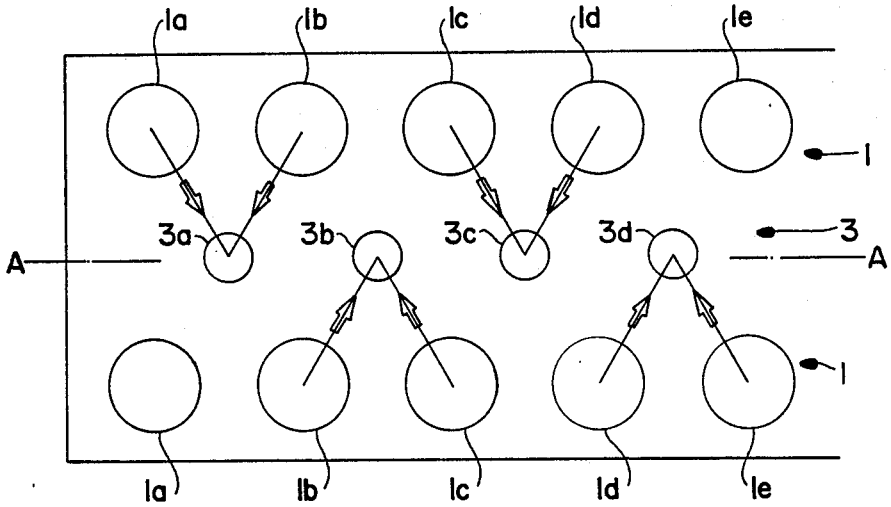

MACHINE FOR CONTINUOUS TWISTING AND CABLING

BACKGROUND OF THE INVENTION

The present invention relates to an improved machine for continuous twisting and cabling.

In the rest of the description, the machine according to the invention will be designated by the expression "twisting and cabling machine."

For the record, it will be recalled that cabled yarns are articles obtained by assembling at least two filaments by twisting (in a cabling operation), the filaments having previously received a twist in a so-called "twisting" operation. These articles have numerous uses and are used, for example, for providing textile reinforcements to be included in the fabrication of tires, belts, conveyor belts, and the like The oldest technique for making such cabled yarns, which is still utilized today, consists of making the cabled yarn in two stages, which are carried out on separate machines. The elementary filaments are twisted (in the so-called twisting operation), for example on a twister or a multiple-twisting machine and, then assembled in a cabling operation also on a twisting or multiple-twisting machine. The twist in the cabling operation may be either in the same direction or in the opposite direction to the initial twist of the filaments which constitute the cabled yarn. Furthermore, complementary treatments can be carried out at the same time as these operations, for example a drawing treatment and/or a thermal treatment.

This technique presents numerous disadvantages, the principal ones being:

- the risk of defects, because, on the one hand, of the various manipulations to which the windings of the filament are subjected during the different stages; and, on the other hand, tension variations that are produced during the cabling operation;
- numerous manual operations because of the various manipulations that such a process requires;
- the substantial floor area that is occupied as a result of the utilization of two distinct machines, and because storage areas must be provided between the two phases of the process.

To reduce these difficulties, it has been recommended for a very long time to carry out the twisting and cabling operations continuously on a single machine comprising:

- a so-called twisting zone, in which a twist is given to each of the elementary filaments, for example by means of single-twisting or two-for-one twisting spindles; and
- a so-called cabling zone, in which several filaments, previously twisted by the twisting operation, are assembled, this assembly being carried out by means of two-for-one twisting spindles or single-twisting ring-and-traveler spindles.

The solution utilized most currently, which is similar to that which has been employed in the field of machines for texturization by false twisting, has consisted in providing so-called "three body" machines; which, generally speaking, have the form of a central body, on both sides of which the cabling spindles are mounted side by side; and, disposed facing each of the sides of this central part, and spaced from the latter so as to leave a vacant passage for the operator, a frame on which are mounted the spindles which permit the twisting of the elementary filaments to be carried out, the twisted filaments being guided to the cabling zone while passing above the vacant service area.

Such a type of installation permits continuous twisting and cabling operations to be carried out, but does not practically solve the problem of the floor space that the equipment requires. Moreover, it is apparent that the automation of such equipment is difficult and complex to carry out.

Another solution, which was the object in particular of U.S. Pat. No. 2,979,882 and British Pat. No. 788,242, consists in disposing the twisting spindles and the cabling spindles one above the other, the twisting spindles being generally disposed in the upper part of the machine and mounted horizontally, as illustrated in U.S. Pat. No. 2,979,882, the cabling spindles being mounted vertically on the frame. Such a solution presents the disadvantage of causing the equipment to have a substantial height, which leads to difficulty in the loading of the bobbin holders. Moreover, the twisting spindles are mounted in the upper part of the machine, which can cause difficulties when the machine is operated, and particularly vibrations, which limit the rate of production. Furthermore, the loading and unloading of the bobbins can be automated only with difficulty, with such a design, given the different inclinations of the feeding and receiving bobbins.

Another arrangement of the twisting and cabling spindles has also been considered for a very long time, as shown in U.S. Pat. No. 897,129 (filed Nov. 3, 1906), and French Pat. No. 1,062,599.

In these two documents, the work positions are disposed on both sides of a common support frame, each side of the machine, constructed in this way, including a cabling section and a twisting section, the twisting spindles being disposed at a lower level than the cabling spindles, and toward the outsides of the machine, while the cabling spindles are, for their part, disposed in proximity to the central column of the frame. In this type of equipment, a filament feeding device is disposed between the twisting and cabling parts, this feeder performing the function of a joining component for joining the twisted elementary filaments so that they can be cabled together. Furthermore, breakage detectors are also provided.

In U.S. Pat. No. 897,129, the spindles for the twisting of the elementary filaments are disposed in a single row, while in French Pat. No. 1,062,599, they are disposed in two rows.

In other words, and in summary, it can be said that according to these two documents, on both sides of a common support frame, two distinct assemblies are found, identical and symmetrical, including at the same time, a series of multiple-twisting spindles and a series of cabling spindles.

This type of equipment is satisfactory, but, on the one hand, it is not adapted to permit simple and efficient automation of the mounting and the removal of the bobbins, given that the zone situated above the spindles is not vacant.

Furthermore, owing to its very design, it entails the use of heavy machine frames, since the vibration problem can be serious, particularly in the solution that is the object of French Pat. No. 1,062,599, in view of the elevated position of the cabling assemblies.

Moreover, such a type of equipment is not easy to use, given that it is difficult to make cabled yarns having different numbers of elementary ends, for example to change over from manufacturing a cabled yarn including two elementary ends, to the manufacture of a cabled yarn including three elementary ends.

Accordingly, there has been found, and this is the object of the present invention, an improvement upon the equipment that is the object of the above-cited patents, and more particularly to the type of equipment that is the object of U.S. Pat. No. 897,129, which permits twisting/multiple-twisting machines to be provided; in which, not only are the problems of vibration reduced to a minimum, and the frame structure can be made lighter and simplified; but also which can be used, without any particular modification, to make cabled yarns that may have a variable number of elementary ends, and more particularly, cabled yarns which may indifferently have two or three ends. Furthermore, because of its design, the equipment according to the invention can easily be automated, access to the twisting and cabling spindles being completely free.

SUMMARY OF THE INVENTION

Generally speaking, the invention accordingly relates to an improved machine for continuous multiple-twisting and twisting of filaments, of the type including a predetermined number of work positions disposed on a common support frame, each work position including, taken in order according to the the filament transformation process:

- a feeding and twisting section for each elementary filament, on each side of the machine;
- means for the return and joining of a predetermined number of elementary filaments thus twisted;
- a cabling and winding section; and it is characterized in that the cabling and winding section is common to the two feeding and twisting sections, and it is constituted of spindles disposed side by side, vertically, this being in the vertical plane of symmetry passing between the two feeding and twisting sections.

Preferably, according to the invention:

- the cabling and winding spindles are disposed in the central part of the machine, staggered with respect to the twisting spindles;
- the twisting spindles are disposed, on each side of the machine, in a single row;
- the support frame of the twisting spindles and the cabling spindles is constituted by an assembly in the form of a caisson, including, as seen in transverse cross-section, two lateral levels supporting the twisting spindles, and one central level slightly elevated with respect to the lateral levels;
- the means for the return and joining of the twisted elementary filaments, in order to guide them to the cabling section, are disposed in an upper portion of the machine and are fixed on crosspieces attached to columns disposed at each end of the spindle support frame.

In such an embodiment of the invention, in which the cabling spindles are common to the two sides of the machine, it is possible to create, indifferently, cabled yarns which may have variable numbers of ends, for example, cabled yarns with two or three ends. Moreover, access, both to the twisting spindles and the cabling spindles, is made easier, and such an assembly accordingly can be easily automated. Furthermore, such a solution permits the area occupied by the machine to be reduced in width.

BRIEF DESCRIPTION OF THE DRAWINGS

The invention and the advantages that it entails will be, however, better understood by reference to the following example of an embodiment thereof, which is illustrative but non-limiting, and which is illustrated by the attached diagrams, in which:

FIGS. 3 and 4 are schematic views from above, showing respectively the manufacture of a cabled yarn with three ends (FIG. 3) and a cabled yarn with two ends (FIG. 4 on a machine according to the invention.

In the rest of the description, for purposes of simplification, the same elements will be designated by the same reference numerals, possibly with the addition of an index (a, b, c . . . ).

DETAILED DESCRIPTION OF THE PREFERRED EMBODIMENT

Figure 1:
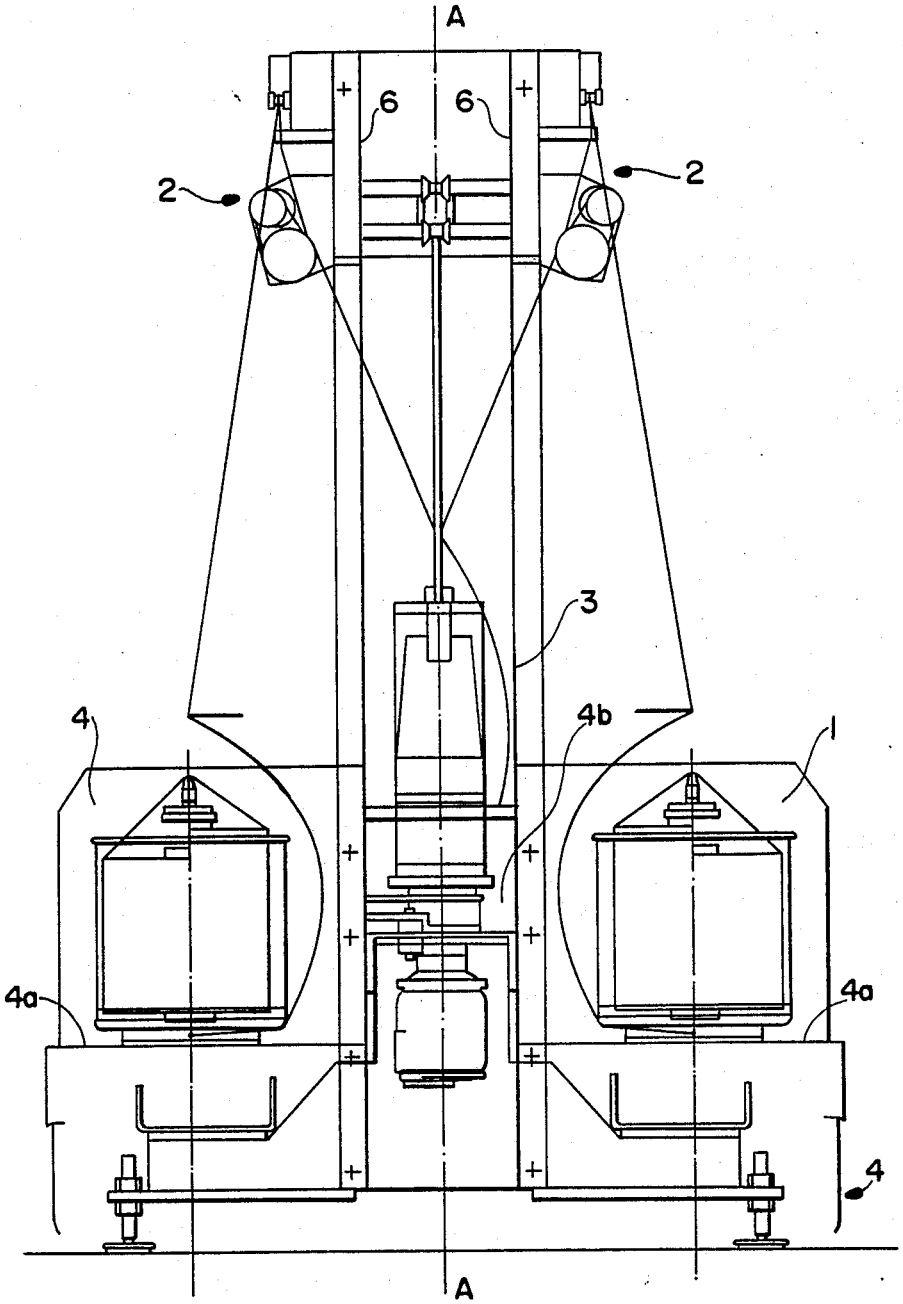
FIG. 1 is an end view of a machine according to the invention.
Figure 2:
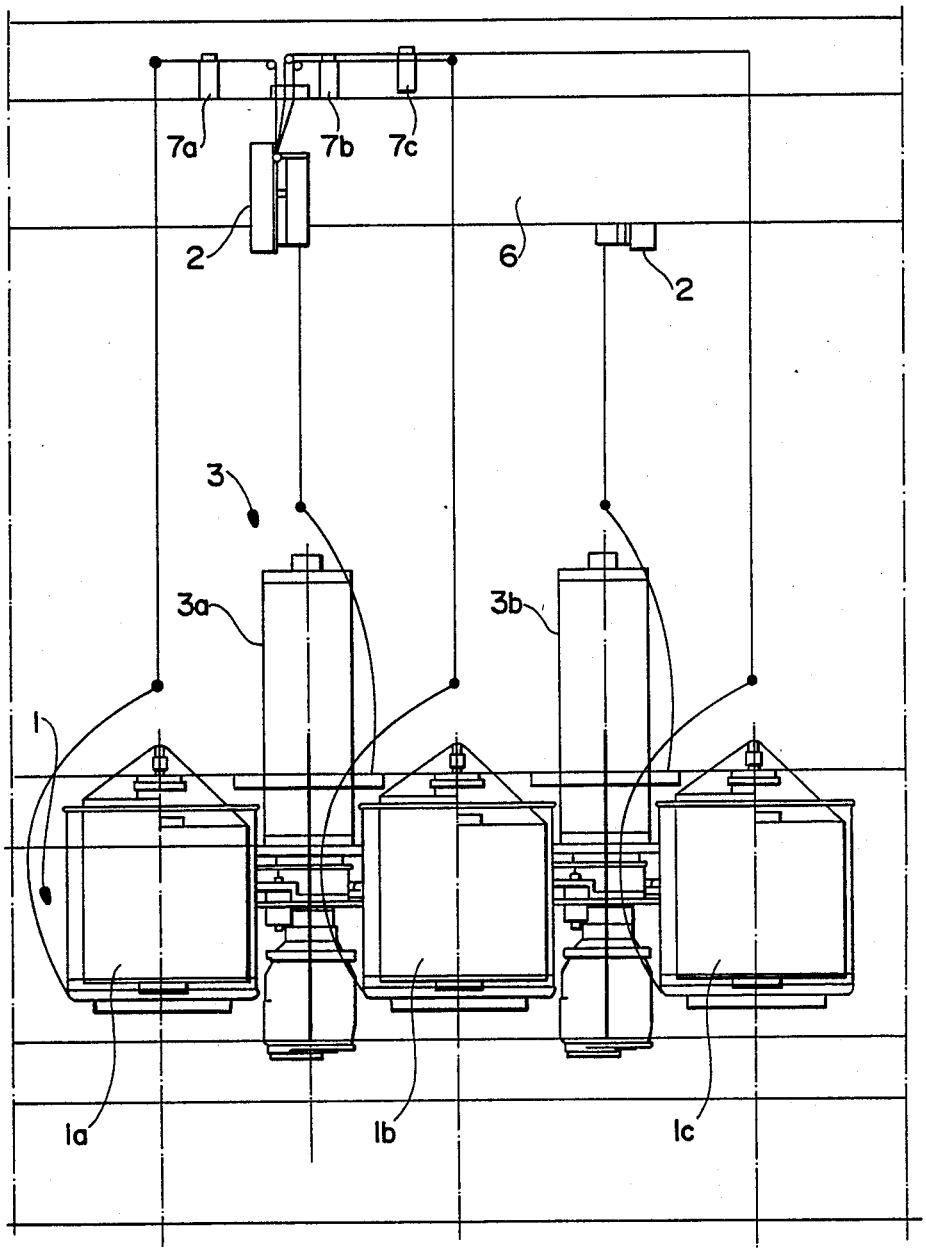
FIG. 2 is a partial side view showing three twisting spindles and two cabling spindles of a machine according to the invention.

Referring to the attached diagrams, and more particularly to FIGS. 1 and 2, the multiple-twisting/twisting machine according to the invention is of the type including a predetermined number of work positions disposed on a common support frame. These work positions include, taken in order according to the transformation process of the filament:

- a feeding and twisting section, designated generally by reference numeral 1, for each elementary filament, this being on each side of the machine;
- return and joining means, designated generally by reference numeral 2, for a predetermined number of elementary filaments thus twisted;
- a cabling and winding section designated generally by reference numeral 3.

In the machine according to the invention, the spindles, for multiple-twisting as well as twisting, are conventional single-twisting or two-for-one twisting spindles.

In the illustrated embodiment of the invention, the spindles 1*a*, 1*b*, 1*c*, etc., in the twisting zone 1 are two-for-one spindles, while the cabling and winding spindles 3*a*, 3*b*, etc., are, for their part, spindles with rings and travelers. These spindles, the twisting spindles as well as the cabling spindles, are also driven in a conventional manner, either by a tangential belt, or by means of individual motors. In the illustrated embodiment of the invention, the cabling spindles 3*a*, 3*b*, 3*c* are driven by individual motors. The drive of the twisting spindles 1*a*, 1*b*, etc., is not shown, and can be constituted either by individual motors, or possibly by means of an endless belt driven by a common motor. These components being well known in the textile field, they will not be described in detail.

Furthermore, the means 2 for the return and joining of the elementary filaments will be constituted by filament feeders of a known type.

According to the invention, the cabling and winding section 3 is common to the two feeding and twisting sections 1. This cabling section 3 is constituted by spindles 3*a*, 3*b*, 3*c*, etc., disposed side by side, vertically, this being in the vertical plane of symmetry AA which passes between the two feeding and twisting sections 1.

As shown in FIGS. 3 and 4, the cabling and winding spindles 3*a*, 3*b*, 3*c*, etc., are disposed in the central part of the machine, staggered with respect to the twisting spindles 1*a* 1*b*, 1*c* . . . , the latter being disposed on each side of the machine in a single row.

The mounting of the twisting spindles and the cabling and winding spindles 3 is carried out by means of a support frame designated generally by reference numeral 4 (see FIGS. 1 and 2). This support frame 4 forms a caisson including, as seen in transverse cross-section (FIG. 1), two lateral levels 4*a* on which the twisting spindles 1 are mounted, and one central level 4*b*, slightly elevated with respect to the lateral levels 4*a* and supporting the cabling spindles 3.

The feeding, returning and joining means 2 are, for their part, disposed in the upper part of the machine. The support of these feeding means 2 is obtained by providing, at each end of the machine, columns 5 which are interconnected by upper crosspieces 6. The transmission of commands to the feeder 2 also occurs in the upper part of the machine, and this is common to the assembly of all these feeders 2.

Owing to such a structure, and as shown in the side view in FIG. 2, an assembly is obtained in which the cabling spindles 3 can be utilized indifferently in cooperation with either one side or the other of the twisting spindles 1. Such possibilities of utilization are illustrated by FIGS. 3 and 4, which show respectively, on the one hand, in FIG. 3, the manufacture of a cabled yarn with three ends, and on the other hand, in FIG. 4, the manufacture of a cabled yarn with two ends. It is apparent that in the case of the manufacture of a cabled yarn with three ends, one of three cabling spindles (e.g., the spindle 3*c*) is not used.

To guide the individual filaments coming from the twisting spindles 1, return components 7*a*, 7*b*, 7*c*, etc., (see FIG. 2) are provided in the upper part of the machine and permit the desired number of filaments to be joined before they pass into the feeding and joining system 2 per se.

Such a twisting and cabling machine, particularly simple in design, presents numerous advantages with respect to the prior solutions, and particularly:

- a reduced space requirement, more particularly in the width direction, given that there is no longer any central vertical frame;
- the possibility of manufacturing cabled yarns including indifferently a greater or lesser number of elementary ends;
- practically total elimination of vibrations, in view of the fact that all the rotating masses and parts are brought down to the lower part of the machine; and
- the possibility of easier automation, given that access to the different spindles is completely free.

Of course, the invention is not limited to the above-described embodiment thereof, but covers all variations created in the same spirit.

I claim:

1. A machine for twisting and cabling a plurality of elementary filaments, comprising:

an elongate support frame having a lengthwise vertical plane of symmetry;

a feeding and twisting section comprising a row of feeding and twisting spindles provided on said support frame and symmetrically arranged on each side of said vertical plane of symmetry, such that a feeding and twisting spindle is provided for each of said plurality of elementary filaments;

a cabling and winding section common to each row of said feeding and twisting spindles, said cabling and winding section comprising a row of cabling and winding spindles provided on said support frame and arranged along said vertical plane of symmetry, each of said cabling and winding spindles being arranged in a plane which is substantially perpendicular to said vertical plane of symmetry and which is located substantially between adjacent feeding and twisting spindles; and means for feeding, returning, and joining said plurality of elementary filaments from said feeding and twisting section to said cabling and winding section.

2. The machine of claim 1, wherein said elongate support frame comprises, when viewed in a plane perpendicular to said vertical plane of symmetry, two lateral levels for supporting the rows of feeding and twisting spindles, and a central level located between the two lateral levels for supporting the row of cabling and winding spindles, said central level being slightly elevated with respect to said lateral levels.

3. The machine of claim 1, wherein said elongate support frame further comprises a column disposed at each end of said support frame and cross pieces connecting upper portions of said columns, and said means for feeding, returning, and joining is fixed to said cross pieces to guide elementary twisted filaments from said feeding and twisting spindles to said cabling and winding spindles.

4. The machine of claim 1, wherein said feeding and twisting spindles comprise two-for-one spindles or single-twisting spindles, and said cabling and winding spindles comprise single-twisting ring-and-traveler spindles or two-for-one twisting and winding spindles.

* * * * *